US006557326B1

(12) United States Patent
Panneri

(10) Patent No.: US 6,557,326 B1
(45) **Date of Patent: *May 6, 2003**

(54) BANDING FIXTURE

(75) Inventor: Peter A. Panneri, Lancaster, NY (US)

(73) Assignee: A. J. Panneri Enterprises, Inc., Cheektowaga, NY (US)

( * ) Notice: Subject to any disclaimer, the term of this patent is extended or adjusted under 35 U.S.C. 154(b) by 105 days.

This patent is subject to a terminal disclaimer.

(21) Appl. No.: 09/732,662

(22) Filed: Dec. 8, 2000

(51) Int. Cl.[7] ..... B65B 27/06; B65B 13/02
(52) U.S. Cl. ..... 53/586; 100/25
(58) Field of Search ..... 53/586, 589, 590; 100/10, 25, 26

(56) References Cited

U.S. PATENT DOCUMENTS 3,021,653 A * 2/1962 Marshall ..... 53/586
4,162,600 A * 7/1979 Westall et al. ..... 53/590
4,570,422 A * 2/1986 Watanabe et al. ..... 53/583
4,783,948 A * 11/1988 Kando ..... 53/586
4,832,767 A * 5/1989 Eller ..... 53/586
4,852,329 A * 8/1989 Terragnoli ..... 53/399
4,875,325 A * 10/1989 Gamberini et al. ..... 53/586
4,930,293 A * 6/1990 Hanscom ..... 53/590
5,063,803 A * 11/1991 Panneri et al. ..... 53/586

OTHER PUBLICATIONS

Previous fixture, no date.

* cited by examiner

*Primary Examiner*—Stephen F. Gerrity
(74) *Attorney, Agent, or Firm*—Joseph P. Gastel

(57) ABSTRACT

A banding fixture including a body having a horizontal opening therein, a carriage movable into and out of the horizontal opening, a recess in the carriage, and the carriage with the recess therein movable into the horizontal opening with a surface in the carriage in underlying near contiguous relationship to an undersurface of a plate on the body. A method of banding a workpiece including the steps of pressing a workpiece overlying a band into a recess in a member, and moving the member relative to a surface so that the ends of the band which extend beyond the workpiece are pressed together in overlapping relationship as the member passes in contiguous relationship to the surface.

11 Claims, 6 Drawing Sheets

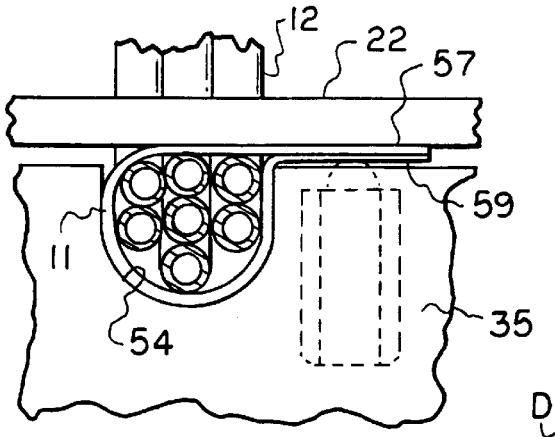
FIG. 10
FIG. 12
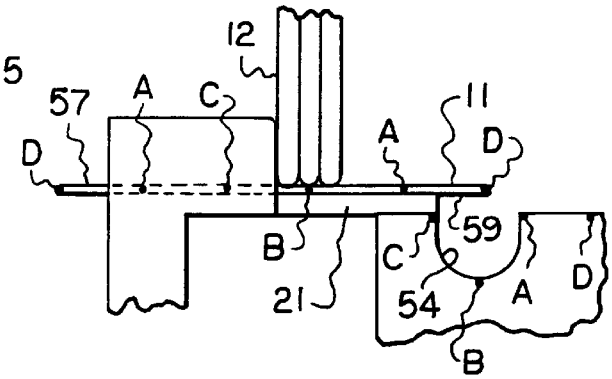
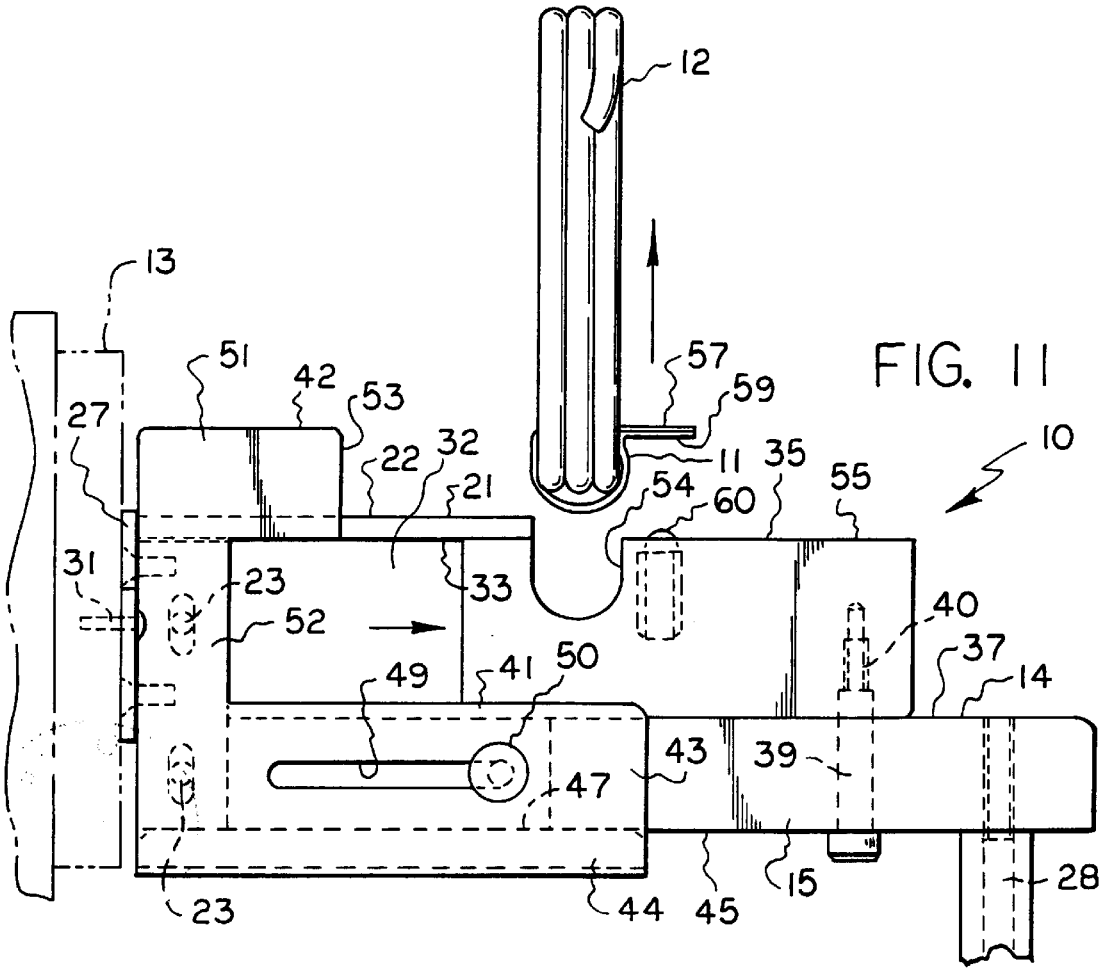
FIG. 11

BANDING FIXTURE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The present invention relates to an improved banding fixture for applying a band to a workpiece such as a coil or a bundle of material and to an improved banding method.

By way of background, coiled material such as tubing, wire, flexible plastic or a bundle of material require bands to retain them in assembled condition.

BRIEF SUMMARY OF THE INVENTION

It is one object of the present invention to provide a banding fixture for a workpiece consisting of coiled material or a bundle of material wherein the fixture accepts a predetermined length of band and is manually manipulatable to cause the band to be secured around a section of the workpiece.

Another object of the present invention is to provide an improved method of banding a workpiece which involves a series of simple and efficient manipulations. Other objects and attendant advantages of the present invention will readily be perceived hereafter.

The present invention relates to a banding fixture comprising a body, a horizontal opening in said body, an overlying portion on said body overlying said horizontal opening, an undersurface on said overlying portion, a carriage movable into and out of said horizontal opening, a recess in said carriage, first and second carriage portions on opposite sides of said recess, an upper surface on at least one of said first and second carriage portions positioned in underlying near contiguous relationship with said undersurface when said recess underlies said overlying portion.

The present invention also relates to a method of banding a workpiece comprising the steps of providing a length of band having a central portion and outer end portions and a side with a cohesive substance thereon, placing said length of band on a first surface with said cohesive substance facing away from said first surface, providing a workpiece having an outer side with adjacent sides proximate said outer side and an inner side opposite to said outer side, positioning said workpiece with said outer side on said central portion of said band having said cohesive substance thereon, moving said workpiece and said band into a recess in a member to cause portions of said central portion of said band to move alongside said adjacent sides and to cause an additional portion of said central portion and one of said end portions adjacent said additional portion to extend beyond said one of said adjacent sides and to cause the other of said end portions to extend beyond the other of said adjacent sides, and moving said member past a second surface to cause said additional portion of said central portion of said band to extend across said inner surface and to cause said end portions of said band to lie in pressed cohesive engagement between said second surface and a third surface which is adjacent to said recess.

The various aspects of the present invention will be more fully understood when the following portions of the specification are read in conjunction with the accompanying drawings wherein:

BRIEF DESCRIPTION OF THE SEVERAL VIEWS OF THE DRAWING

FIG. 10 is an enlarged fragmentary side elevational view of a portion of FIG. 9 showing in greater detail the cohesive tape encircling the coil;

FIG. 11 is a fragmentary side elevational view of the banding fixture with the carriage moved to the position wherein the coil is removed from the recess; and FIG. 12 is a schematic view showing the dimensioning of the tape for causing the extreme edges of the tape to lie flush with each other.

DETAILED DESCRIPTION OF THE INVENTION

Summarizing briefly in advance, the banding fixture 10 and banding method are for applying bands 11 (FIGS. 1 and 11) to a workpiece consisting of a coil 12 of tubing or any other type of coiled material or a bundle of material. The bands 11 are received in a predetermined length from a banding machine 13 of any type which can supply it. Each band, by manual manipulation and the use of fixture 10, can then be banded about the workpiece. At this point it is to be noted that the description refers to a workpiece which is a coil of material. However, it will be understood that the workpiece can be any bundle of material whatsoever or any item which requires a band.

Figure 2:
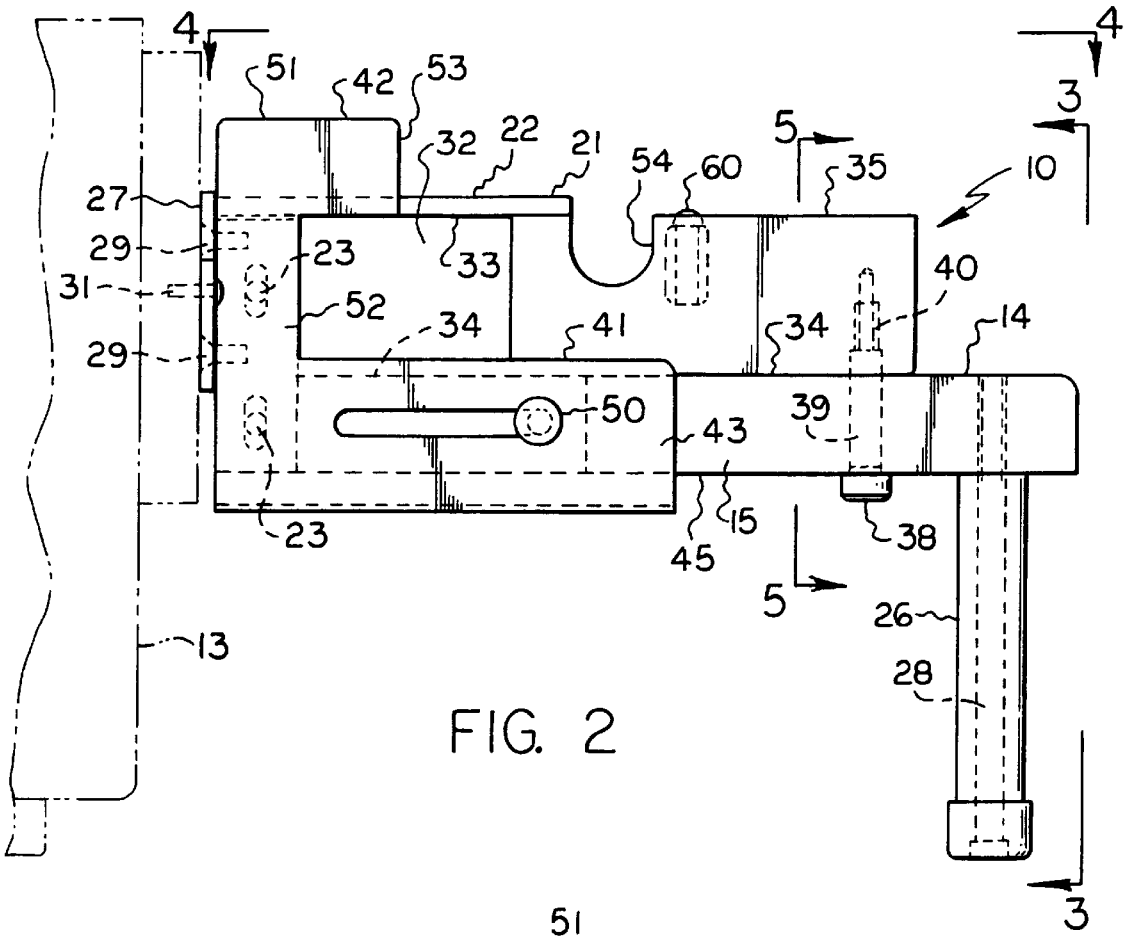
FIG. 2 is a side elevational view of the banding fixture of the present invention.
Figure 3:
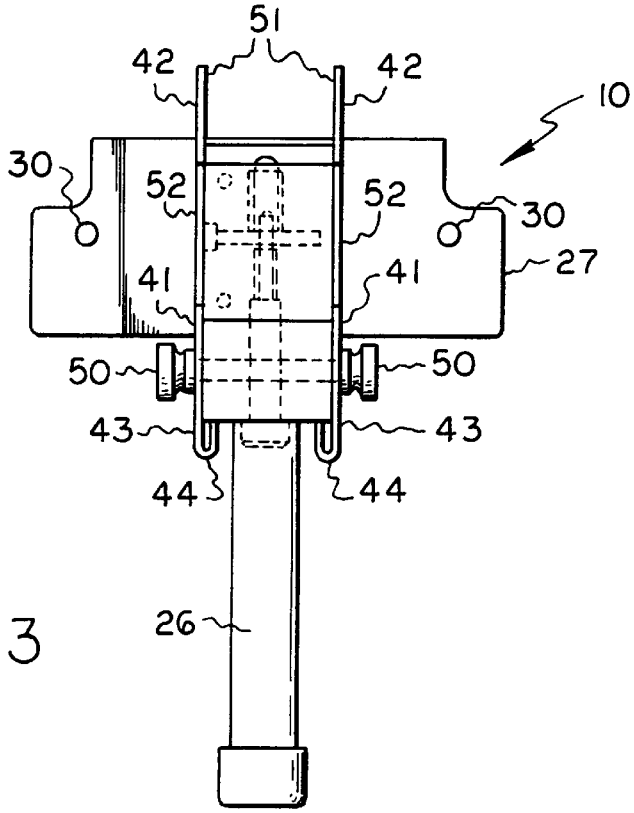
FIG. 3 is an end elevational view taken substantially in the direction of arrows 3—3 of FIG. 2.
Figure 2C:
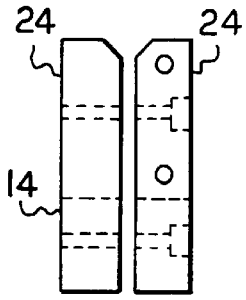
FIG. 2C is an end elevational view of the fixture body.
Figure 2A:
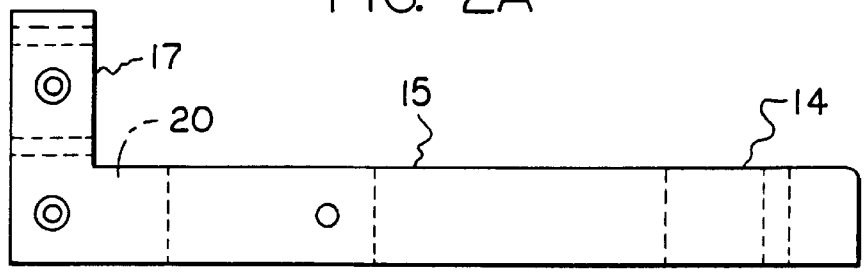
FIG. 2A is a side elevational view of the body of the fixture.
Figure 2B:
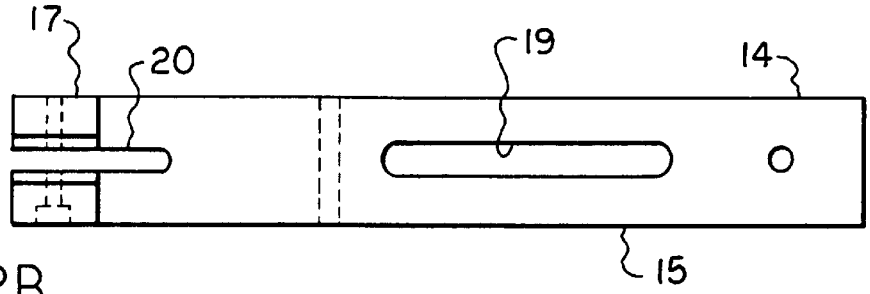
FIG. 2B is a plan view of the body of the fixture.
Figure 4A:
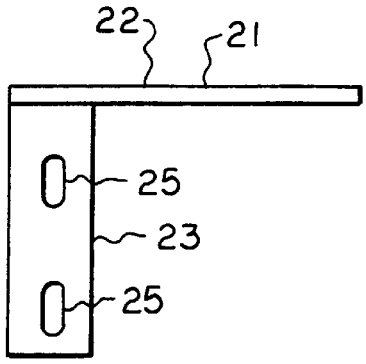
FIG. 4A is a side elevational view of the plate member which mounts on the body of the fixture.
Figure 4B:
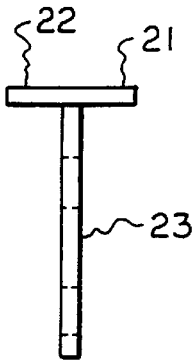
FIG. 4B is an end elevational view of the plate member.
Figure 4:
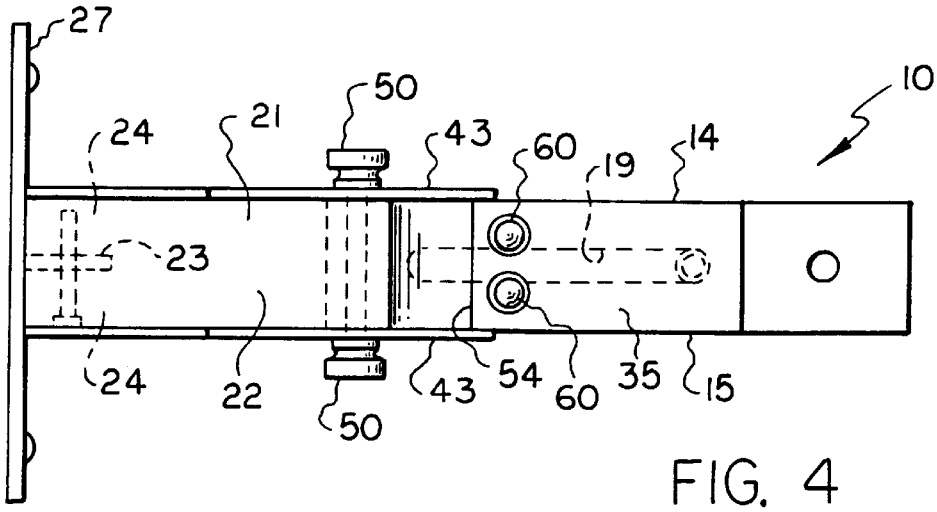
FIG. 4 is a plan view of the banding fixture taken substantially in the direction of arrows 4—4 of FIG. 1.

The banding fixture 10 includes a body 14 fabricated out of a suitable plastic material. Body 14 includes a horizontal portion 15 and a vertical portion 17 (FIG. 2A). The horizontal portion includes an elongated slot 19 and the vertical portion includes a slot 20 which extends into horizontal portion 15. A plate member 21 (FIGS. 4A and 4B) includes a plate 22 with a depending integral vertical portion 23 which fits into slot 20 of body 14 and is secured therein by screws which extend through sides 24 of body 14 and through elongated slots 25 of vertical plate member portion 23. A plate 27 (FIG. 3) is secured to the end of body portion 24 by screws 29, and plate 27 has apertures 30 (FIG. 3) therein to receive screws 31 (FIG. 2) for securing the fixture 10 to the band dispensing machine 13. A leg is attached to body 14 by bolt 28. Leg 26 rests on a supporting surface, such as a table top to stabilize the fixture 10.

In the fully assembled condition of the fixture 10, a horizontal opening 32 is provided between the undersurface 33 of overlying plate 22 and the upper surface 34 (FIG. 2) of body portion 15. A carriage 35 is slidably mounted on the upper surface 34 of body portion 15, and it is retained against surface 34 by means of a bolt 39 which rides in slot 19. The head 38 of bolt 39 bears on the undersurface of body portion 15. In this respect, the bolt 39 is threaded into carriage 35 at 40. The carriage 35 is guided for rectilinear movement on body portion 15 by the upper edges 41 of initial positioning members 42 which initially position the unbanded coil 12 on the fixture. The coil positioning members 42, which are mirror images, include lower sides 43 which have bent over portions 44, the upper edges 47 of which bear against the underside 45 of body portion 15. Each side 43 includes an elongated slot 49 through which a bolt 50 extends. When tightened, the heads of bolts 50 hold sides 43 against movement on body portion 15. The positioning members 42 include upper portions 51 which are connected to lower portions 43 by central portions 52. The upper portions 51 terminate at edges 53 which serve as gauges for initially positioning a workpiece.

Figure 1:
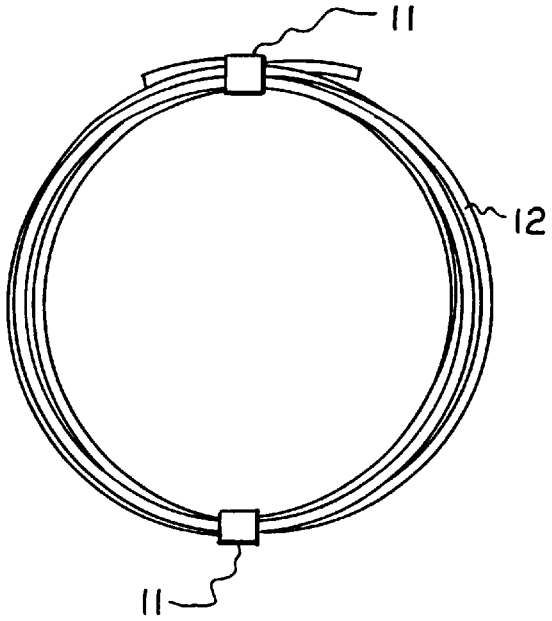
FIG. 1 is a side elevational view of a coil of tubing which is banded by bands which have been applied by the present banding fixture.
Figure 5:
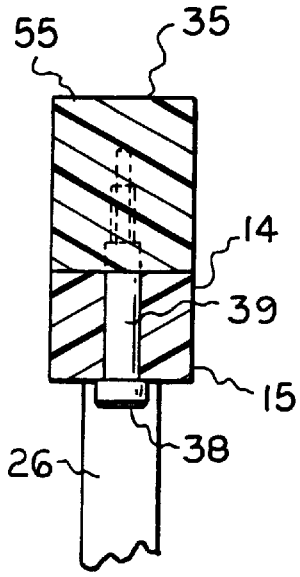
FIG. 5 is a fragmentary cross sectional view taken substantially along line 5—5 of FIG. 2.
Figure 7:
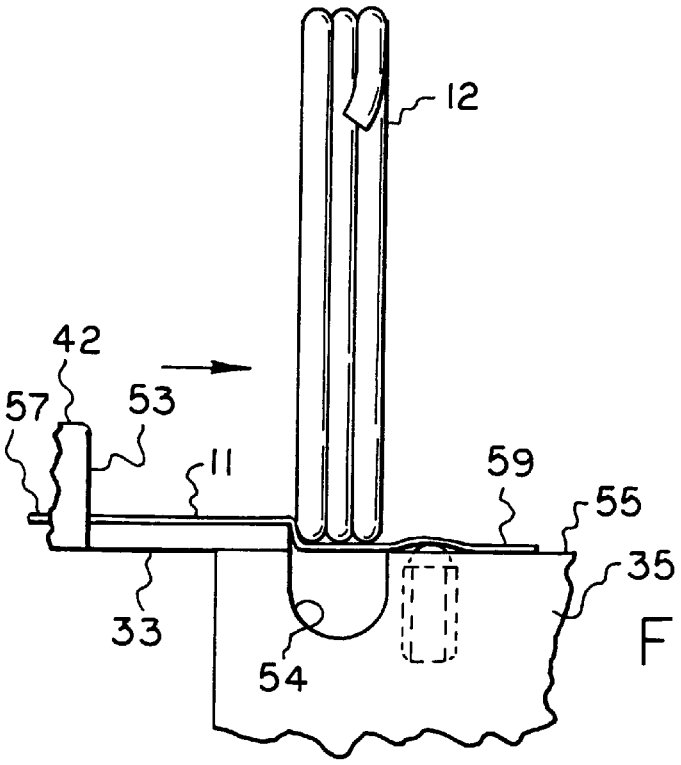
FIG. 7 is a fragmentary side elevational view of the coil moved to a second position overlying a coil-receiving recess in a carriage.
Figure 6:
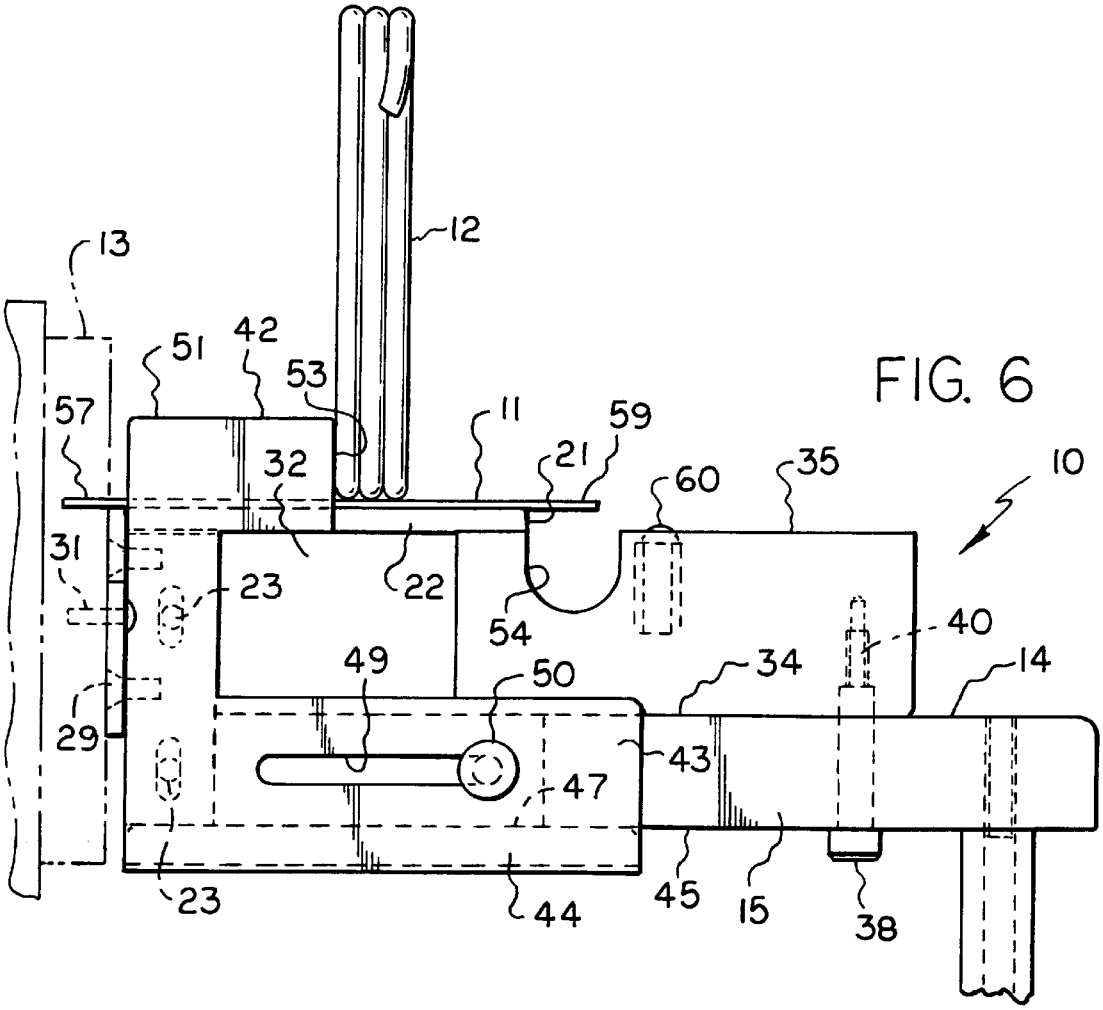
FIG. 6 is a fragmentary side elevational view of the banding fixture with a strip of cohesive tape thereon and with an unbanded coil in an initial position against a positioning member.
Figure 8:
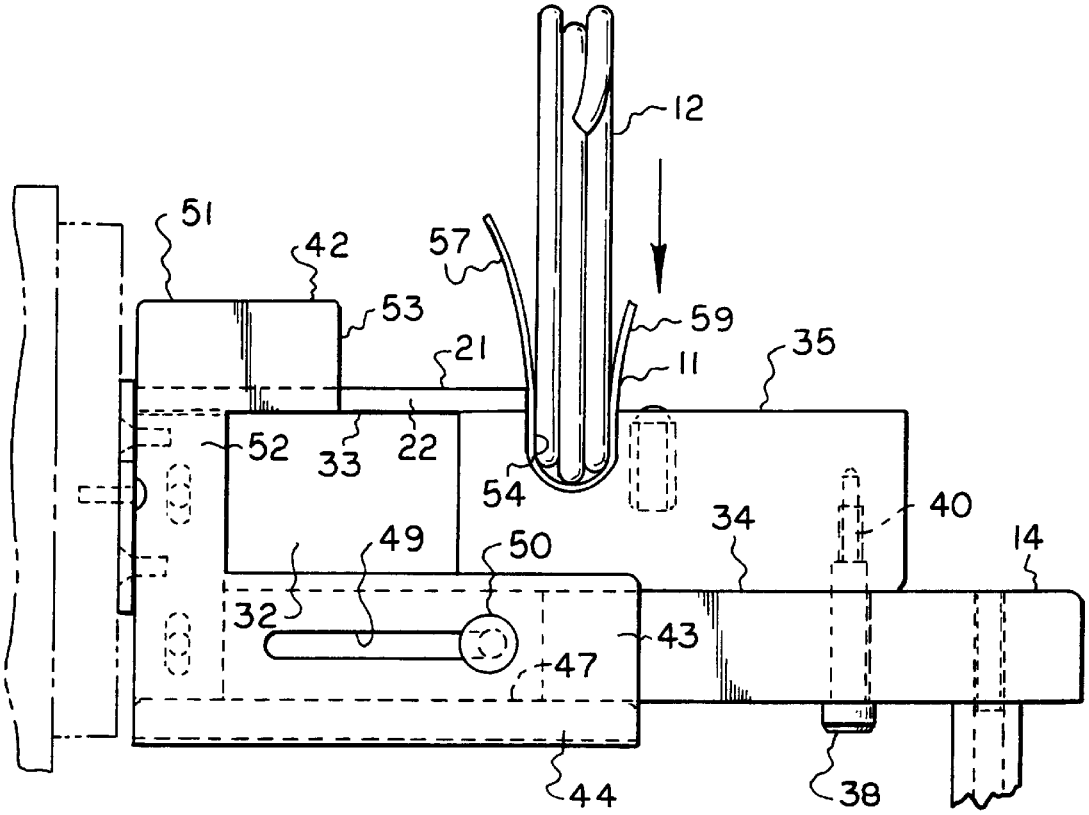
FIG. 8 is a fragmentary side elevational view of the banding fixture with the coil moved into the recess in the carriage.
Figure 9:
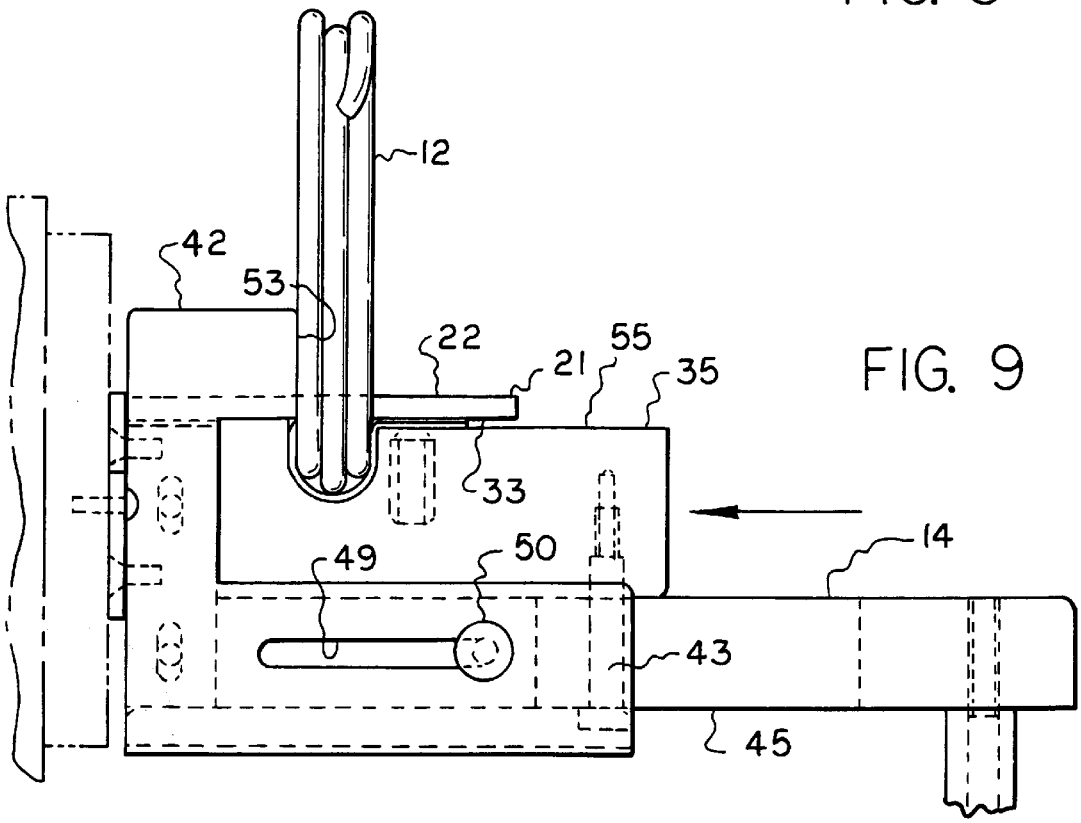
FIG. 9 is a fragmentary side elevational view of the banding fixture with the carriage moved to a position wherein the ends of the cohesive tape are secured to each other with the cohesive tape encircling the coil.

In operation, a predetermined length of cohesive tape with the bonding surface facing upwardly is dispensed from band dispensing machine 13, and it is properly positioned on the upper surface of plate 22. The workpiece in the form of an unbanded coil 12 (FIG. 6) is thereafter manually placed against gauge edges 53 of positioning members 42 (FIG. 6) with the lower outer side of the coil bearing on the central portion of cohesive surface of tape 11. Thereafter, the coil 12 is manually moved to the right with the tape 11 along plate 22 to the position of FIG. 7 where it overlies recess 54 in carriage 35. Thereafter, as shown in FIG. 8, the coil is pressed downwardly into recess 54, and portions of the central portion of tape 11 move upwardly along the sides of the coil portion in the recess. Also, a portion of the central portion of the band and its adjacent end portion extend beyond the portion of the coil in the recess, as shown on the left of the coil in FIG. 8, and the other end portion of the band extends beyond the portion of the coil in the recess, as shown to the right of the coil in FIG. 8. The carriage 35 is then manually moved to the left to its position of FIG. 9. During this movement a portion of the central portion of the tape will be moved across the inner side of the coil portion in the recess 54 and the ends 57 and 59 will be placed face-to-face with each other in overlapping relationship, and the upper surface 55 of carriage 35 will lie in close contiguous relationship to the undersurface 33 of plate 22. During the movement of the coil from the position of FIG. 8 to the position of FIG. 9, the spring-biased balls 60, which protrude outwardly beyond the upper surface 55 of carriage 35, will press ends 57 and 59 of tape 11 into firm mating engagement. Thereafter, the carriage 35 is moved to the position of FIG. 11 so that the coil can be moved upwardly out of carriage-recess 54. The diametrically opposite portion of coil 12 is then inserted into recess 54, and the above process of banding is repeated after another band 11 has been dispensed from band dispenser 13, and the completely applied bands are shown in FIG. 1.

The tape dispensing machine dispenses the tape to a position on plate 21 so that when the coil 12 is placed thereon while it abuts edges 53 of positioning members 42 which serve as a gauge, the extreme end edges of the tape will be flush with each other after the band has been secured about the coil. This is schematically shown in FIG. 12 wherein the midpoint of coil 12 is placed over point B which ultimately is moved to point B at the bottom of the recess. The distance AB is shown both on tape 11 and on the recess. The distance AD is the amount of one end of the tape which is to be bonded to the opposite end of the tape. The distance BC on the tape corresponds to the distance BC in recess 54. The distance AC on the tape corresponds to the distance AC across the opening of recess 54. The distance AD on the left end of the tape corresponds to the distance AD on the right end of the tape such that end portions 57 and 59, when bonded to each other, will have their outer ends at D flush with each other. According to the foregoing dimensioning, the tape 11 will assume the positions shown in FIGS. 10 and 11 when bonding has been completed. In order to achieve the foregoing with reasonable accuracy, the positioning members 42 may be adjusted by loosening bolts 50 and sliding the sides 43 of members 42 to a desired position and thereafter tightening bolts 50. In other words, the positions of positioning members 42 can be adjusted for providing different lengths 57 and 59, which are bonded to each other depending on the total length of the tape and its position as dispensed by dispensing machine 13. In other words, depending on the position of the tape 11 when it is dispensed from the dispensing machine, and depending on the lengths which are desired at 57 and 59, the positioning member 42 can be positioned such that the center of the width of coil 12 will overlie point B on the tape.

While the above description was directed to banding a workpiece in the nature of a coil, it will be appreciated that the banding fixture can be used equally well to band straight material into bundles or to apply a band to any type or types of items.

While a preferred embodiment of the present invention has been disclosed, it will be appreciated that the present invention is not limited thereto but may be otherwise embodied within the scope of the following claims.

What is claimed is:

1. A banding fixture comprising a body, a horizontal opening in said body, an overlying portion on said body overlying said horizontal opening, an undersurface on said overlying portion, a carriage movable into and out of said horizontal opening, a recess in said carriage, first and second carriage portions on opposite sides of said recess, and an upper surface on at least one of said first and second carriage portions positionable in underlying near contiguous relationship with said undersurface when said recess underlies said overlying portion.

2. A banding fixture as set forth in claim 1 wherein the other of said first and second carriage portions is in underlying r elation ship with said undersurface when said recess is not in underlying relationship to said overlying portion.

3. A banding fixture as set forth in claim 2 including a second upper surface on said other of said first and second carriage portions, and wherein both said upper surface and said second upper surface are in underlying relationship to said undersurface when said recess is in underlying relationship to said undersurface.

4. A banding fixture as set forth in claim 1 wherein said overlying portion is a plate.

5. A banding fixture as set forth in claim 1 including an initial workpiece positioning member on said body.

6. A banding fixture as set forth in claim 5 wherein said overlying portion is a plate.

7. A banding fixture as set forth in claim 6 wherein said initial workpiece positioning member is located above said plate.

8. A banding fixture as set forth in claim 7 wherein said initial workpiece positioning member includes a workpiece-contacting edge.

9. A banding fixture as set forth in claim 1 including an adjustable initial workpiece positioning member on said body.

10. A banding fixture as set forth in claim 1 including means for guiding said carriage for rectilinear movement on said body.

11. A banding fixture comprising a body, an opening in said body, an overlying portion on said body overlying said opening, an undersurface on said overlying portion, a carriage movable into and out of said opening, a recess in said carriage, a carriage portion adjacent said recess, and an upper surface on said carriage portion positionable in underlying near contiguous relationship with said undersurface when said recess underlies said overlying portion.

* * * * *